US006588388B2

(12) United States Patent
Watanabe et al.

(10) Patent No.: US 6,588,388 B2
(45) Date of Patent: Jul. 8, 2003

(54) AIR INDUCTION SYSTEM FOR ENGINE

(75) Inventors: Hitoshi Watanabe, Shizuoka (JP); Hiroyuki Tsunekawa, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/965,650

(22) Filed: Sep. 26, 2001

(65) Prior Publication Data

US 2002/0073949 A1 Jun. 20, 2002

Related U.S. Application Data

(60) Provisional application No. 60/322,379, filed on Sep. 13, 2001.

(30) Foreign Application Priority Data

Sep. 26, 2000 (JP) ..... 2000-293171

(51) Int. Cl.[7] ..... F02M 35/10
(52) U.S. Cl. ..... 123/184.36
(58) Field of Search ..... 123/184.55, 184.21, 123/198 E, 184.24, 184.25, 184.26, 519, 184.34, 184.31, 184.35, 184.36, 184.49, 585; 181/229, 204

(56) References Cited

U.S. PATENT DOCUMENTS

| | | | | |
|---|---|---|---|---|
| 4,326,600 | A | | 4/1982 | Okazaki et al. |
| 4,570,744 | A | | 2/1986 | Hoshiba |
| 4,852,686 | A | | 8/1989 | Sougawa |
| 4,887,692 | A | | 12/1989 | Outani et al. |
| 5,133,307 | A | | 7/1992 | Kurihara |
| 5,476,402 | A | | 12/1995 | Nakai et al. |
| 5,488,939 | A | | 2/1996 | Nakai et al. |
| 5,513,606 | A | | 5/1996 | Shibata |
| 5,697,335 | A | * | 12/1997 | Kimura et al. ..... 123/184.21 |
| 5,743,228 | A | | 4/1998 | Takahashi |
| 5,829,402 | A | | 11/1998 | Takahashi et al. |
| 5,855,193 | A | | 1/1999 | Takahashi |
| 5,941,205 | A | | 8/1999 | Hiraoka et al. |
| 6,015,319 | A | | 1/2000 | Tanaka |
| 6,019,083 | A | | 2/2000 | Isogawa |
| 6,062,927 | A | | 5/2000 | Hiraoka et al. |
| 6,125,820 | A | | 10/2000 | Hiraoka |
| 6,142,842 | A | * | 11/2000 | Watanabe et al. ..... 123/184.21 |

OTHER PUBLICATIONS

Coopending patent application No. 09/664,514, filed Sep. 18, 2000, in the name of Hitoshi Watanabe, entitled Four–Cycle Engine and assigned to Sanshin Kogyo Kabushiki Kaisha.

(List continued on next page.)

*Primary Examiner*—Noah P. Kamen
*Assistant Examiner*—Hyder Ali
(74) *Attorney, Agent, or Firm*—Knobbe, Martens, Olson & Bear, LLP.

(57) ABSTRACT

An engine includes an engine body and an air induction system. The engine body has a cylinder block that defines cylinder bores. Pistons are reciprocally disposed within the respective cylinder bores. A cylinder head member closes the respective cylinder bore to define combustion chambers together with the cylinder bores and the pistons. The air induction system is arranged to supply air to the combustion chambers. The air induction system includes intake conduits that communicate with the combustion chambers. Inlet conduits communicate with the intake conduits and extend along the intake conduits to provide a sufficiently long air intake to improve the torque characteristics of the engine. In one preferred outboard marine embodiment, this longer air intake does not require any increase in the size of the engine cowling.

55 Claims, 5 Drawing Sheets

OTHER PUBLICATIONS

Coopending patent application No. 09/688,511, filed Oct. 16, 2000, in the name of Isogawa et al., entitled Engine Throttle Valve Linkage and assigned to Sanshin Kogyo Kabushiki Kaisha.

Coopending patent application No. 09/742,777, filed Dec. 20, 2000, in the name of Watanabe et al., entitled Component Mounting Arrangement for Engine and assigned to Sanshin Kogyo Kabushiki Kaisha.

* cited by examiner

AIR INDUCTION SYSTEM FOR ENGINE

PRIORITY INFORMATION

This application is based on and claims priority to Japanese Patent Application No. 2000-293171, filed Sep. 26, 2000, the entire contents of which are hereby expressly incorporated by reference. This application further claims the benefit of U.S. Provisional Application No. 60/322,379 filed Sep. 13, 2001 entitled "Air Induction System for Engine".

BACKGROUND OF THE INVENTION

1. Field of the Invention

The present invention relates generally to an air induction system for an engine, and more particularly to an improved air induction system for an engine that needs a relatively long intake passage.

2. Description of Related Art

An internal combustion engine typically comprises an air induction system with which air is introduced into one or more combustion chambers of the engine. Typically, the induction system includes a plenum chamber unit and one or more intake conduits. The plenum chamber unit is used to coordinate or smooth the airflow to the combustion chambers and to reduce noise in the induction system. The intake conduits generally extend between the plenum chamber and the combustion chambers to supply air in the plenum chamber to the combustion chambers. The intake conduits, however, not only connect the plenum chamber with the combustion chambers but also used to obtain the desired engine torque curve. Particularly, the length of the intake conduits is one of principal elements to determine the engine torque. In general, if a relatively long conduit is applied, the engine torque can be improved in a range of low and/or middle engine speed. If a relatively short conduit is employed, the engine torque can be improved in a range of high engine speed.

Engines that need the long intake conduit(s) for improved low and middle range torques can pose a difficult problem. For instance, a typical engine for an outboard motor is surrounded by a protective cowling. Space for the long intake conduit(s) is thus extremely limited. Enlarging the protective cowling to make a roomier space is not an acceptable option since outboard motors are required to be as compact as possible for carriage and storage. Increasing the number of parts to form the conduits and unit is also not acceptable since a large number of parts will increase the assembly work and thus the cost of producing the engine.

SUMMARY OF THE INVENTION

Engines constructed in accordance with the preferred embodiments of the invention provide an improved air induction system having a relatively long intake conduit without requiring a roomier space around the engine. These engines do not require a large number of parts or pieces to form the conduits and unit. Rather, they decrease the number of parts that forms the system.

A significant feature of the preferred embodiments is an induction system of extended length that does not require any increase in size to the engine cowling. As a result, these preferred embodiments have improved low and middle range torques.

In accordance with one preferred embodiment of the invention, the air induction system includes a plenum chamber remote from the combustion chamber and connected to the combustion chamber by an intake conduit. In addition, the air induction system includes an additional air inlet conduit extending between an inlet within the protective cowling and the plenum chamber. A significant feature of this preferred embodiment is that this inlet conduit effectively lengthens the intake conduit without impinging upon the limited space within the cowling. Rather, this inlet conduit extends along and between an extended length of the intake conduit.

As a result, improved low and middle range torques are achieved without sacrificing the advantages of a compact engine cowling.

Another feature of the preferred embodiment is that a minimum number of parts are required to assemble the air induction system. Thus, the plenum chamber, the intake conduits between the combustion chamber and plenum chamber, and the inlet conduits between the air space within the cowling and the plenum chamber are substantially provided by two formed plastic members.

One preferred embodiment of the air induction system described is configured for an engine having two cylinder banks, one of which is disposed on the port side of the engine and the other disposed on the starboard side. Two air induction systems, are used to supply air to the two cylinder banks with the plenum chambers of one system closely disposed to the plenum chamber of the other system in front of the engine crankshaft member. A series of side-by-side inlet conduits and intake conduits are respectively coupled to the plenum chambers. As further described below, the two plenum chambers are advantageously connected by air pressure balancer hoses.

Another feature of the preferred embodiments is improved air induction system for an engine that can effectively reduce noise.

An additional aspect of the preferred embodiments of the air induction system is that the flow of air is reversed within the plenum chamber so that the air flowing into the inlet conduit flows in the opposite direction of air flowing from the plenum chamber to the engine's combustion chamber.

In accordance with one aspect of a preferred embodiment of the present invention, an internal combustion engine comprises an engine body and an air induction system enclosed in a protective cowling. The engine body includes a cylinder block defining at least one cylinder bore. A piston is reciprocally disposed within the cylinder bore. A cylinder head member closes the respective cylinder bores to define a combustion chamber together with the cylinder bore and the piston. The air induction system is arranged to supply air to the combustion chamber. The air induction system includes an intake conduit communicating with the combustion chamber. An inlet conduit communicates with the intake conduit and, at least in part, extends along the intake conduit.

In accordance with another aspect of a preferred embodiment of the present invention, an internal combustion engine comprises an engine body and an air induction system. The engine body includes a cylinder block defining at least two cylinder bores. Pistons are reciprocally disposed within the respective cylinder bores. A cylinder head member closes each one of the respective cylinder bores to define at least two combustion chambers together with the cylinder bores and the pistons. The air induction system is arranged to supply air to the combustion chambers. The air induction system includes at least two intake conduits communicating with the combustion chambers. An inlet conduit communicates with both of the intake conduits. The inlet conduit, at least in part, extends along the intake conduits.

In accordance with a further aspect of a preferred embodiment of the present invention, an internal combustion engine comprises an engine body. A moveable member is moveable relative to the engine body. The engine body and the moveable member together define a combustion chamber. An air induction system is arranged to supply air to the combustion chamber. The air induction system includes an intake conduit communicating with the combustion chamber. A plenum chamber member defines a plenum chamber located upstream of the intake conduit. An inlet conduit communicates with the plenum chamber to introduce the air into the plenum chamber. The inlet conduit, at least in part, is unitarily formed with the intake conduit.

In accordance with a still further aspect of a preferred embodiment of the present invention, an internal combustion engine comprises an engine body. At least two moveable members are moveable relative to the engine body. The engine body and the moveable members together define at least two combustion chambers. An air induction system is arranged to supply air to the combustion chambers. The air induction system includes first and second intake conduits communicating with the combustion chambers. The first intake conduit extends on a first side of the engine body. The second intake conduit extends on a second side of the engine body. The second side is located generally oppositely to the first side relative to the engine body. At least one plenum chamber member defines a plenum chamber located upstream of the first and second intake conduits. First and second inlet conduits communicate with the plenum chamber. The first inlet conduit, at least in part, extends generally along the first intake conduit. The second inlet conduit at least in part extends generally along the second intake conduit.

In accordance with a yet further aspect of a preferred embodiment of the present invention, an internal combustion engine comprises an engine body. A moveable member is moveable relative to the engine body. The engine body and the moveable member together define a combustion chamber. An air induction system is arranged to supply air to the combustion chamber. The air induction system includes an intake conduit communicating with the combustion chamber. A plenum chamber member defines a plenum chamber located upstream of the intake conduit. An inlet conduit communicates with the plenum chamber to introduce the air into the plenum chamber. The inlet conduit, at least in part, extends generally along the intake conduit.

In accordance with a further aspect of a preferred embodiment of the present invention, an outboard motor comprises a drive unit and a bracket assembly adapted to be mounted on an associated watercraft to support the drive unit. The drive unit includes an internal combustion engine. The engine comprises an engine body. A moveable member is moveable relative to the engine body. The engine body and the moveable member together define a combustion chamber. An air induction system is arranged to supply air to the combustion chamber. The air induction system includes an intake conduit communicating with the combustion chamber. A plenum chamber member defines a plenum chamber located upstream of the intake conduit. An inlet conduit communicates with the plenum chamber to introduce the air into the plenum chamber. The inlet conduit has an opening positioned opposite to the bracket assembly relative to the plenum chamber member.

BRIEF DESCRIPTION OF THE DRAWINGS

These and other features, aspects and advantages of the present invention will now be described with reference to the drawings of preferred embodiments, which an embodiment is intended to illustrate and not to limit the present invention. The drawings comprise five figures.

DETAILED DESCRIPTION OF THE PREFERRED EMBODIMENT OF THE INVENTION

The Overall Construction

Figure 1:
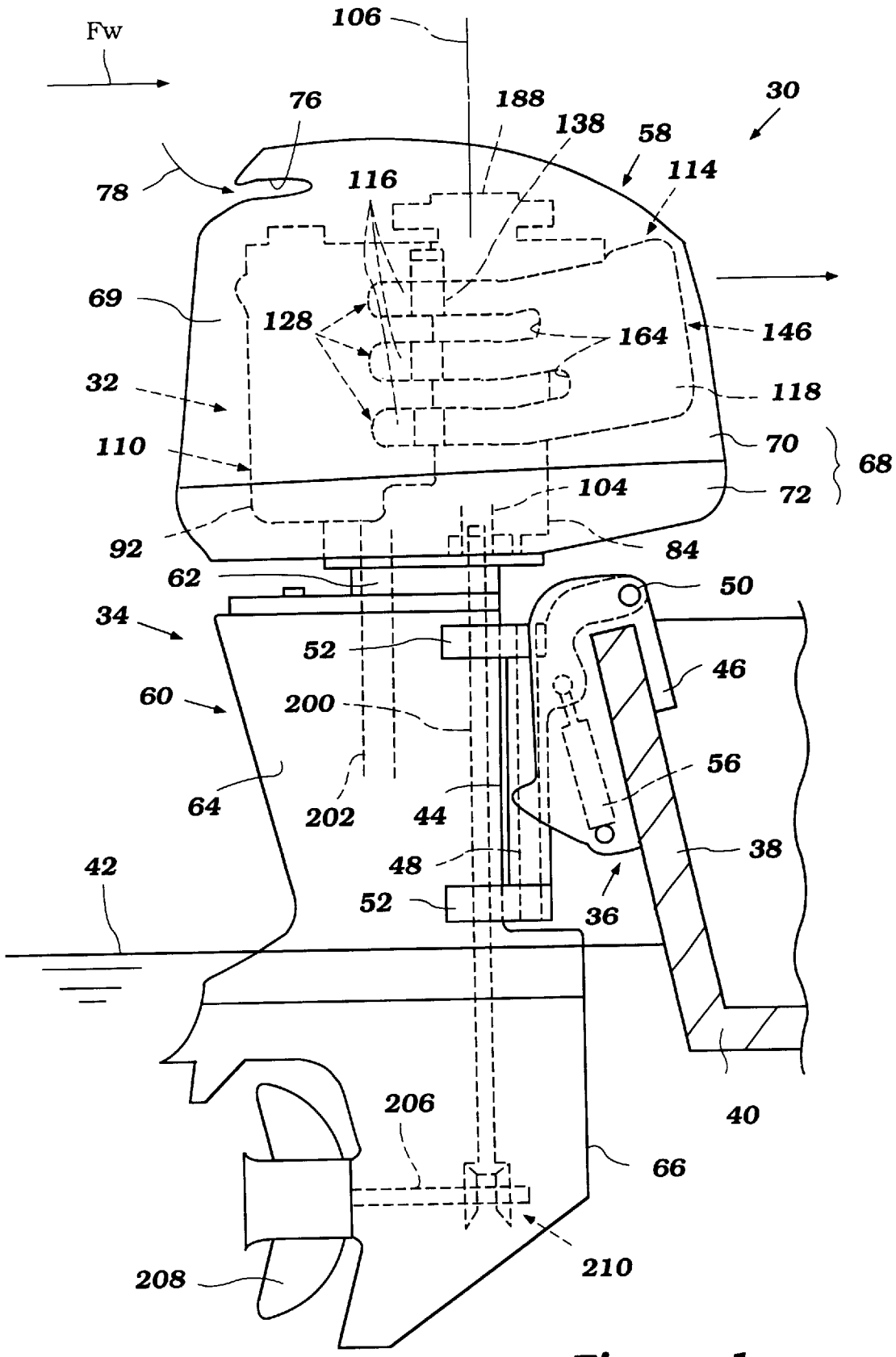
FIG. 1 is a side elevation view of an outboard motor configured in accordance with a preferred embodiment of the present invention. An associated watercraft is partially shown in section.
Figure 2:
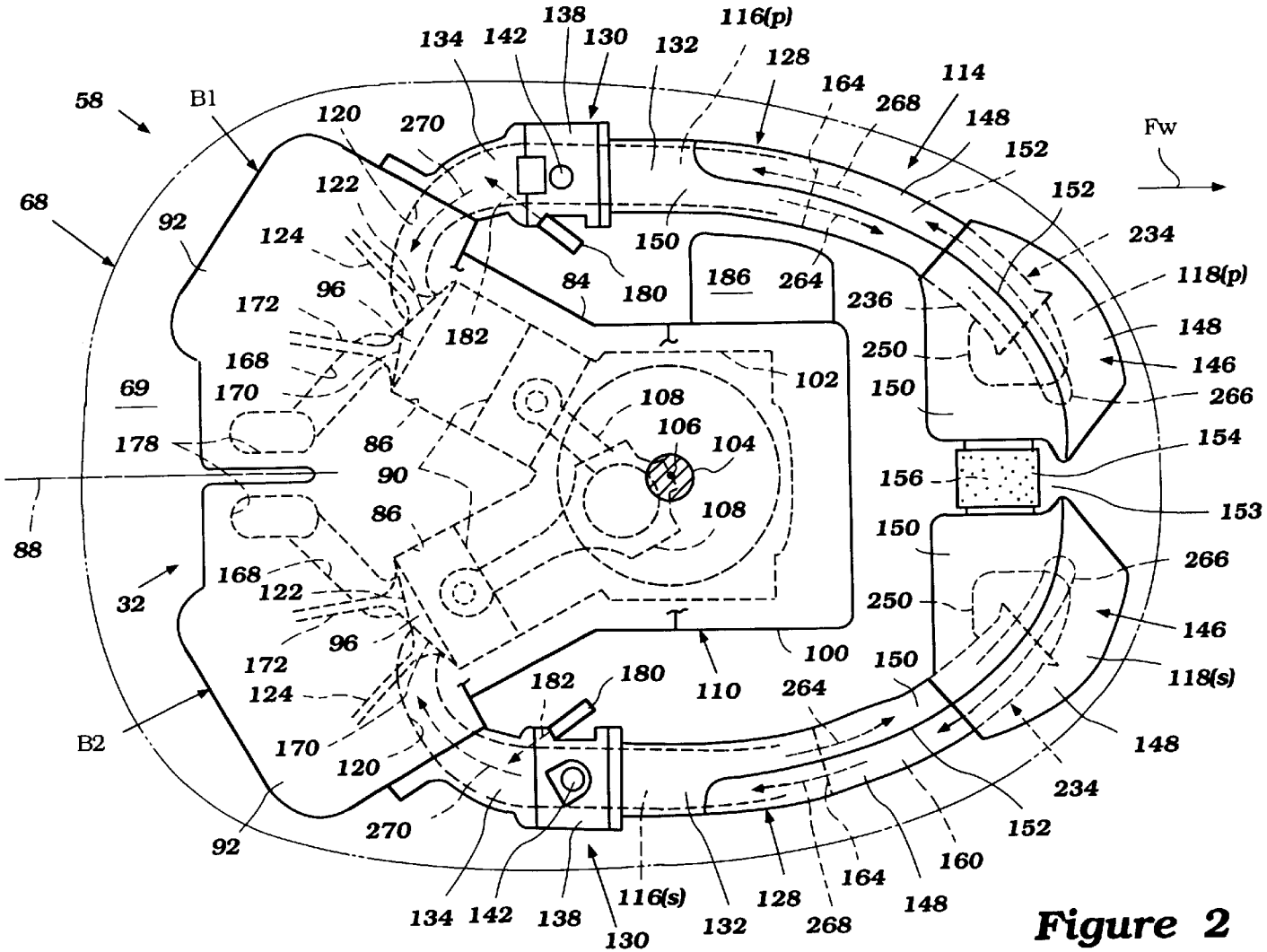
FIG. 2 is a top plan view of an exemplary V-configured engine applied for the outboard motor. A protective cowling assembly is shown in phantom line.
Figure 3:
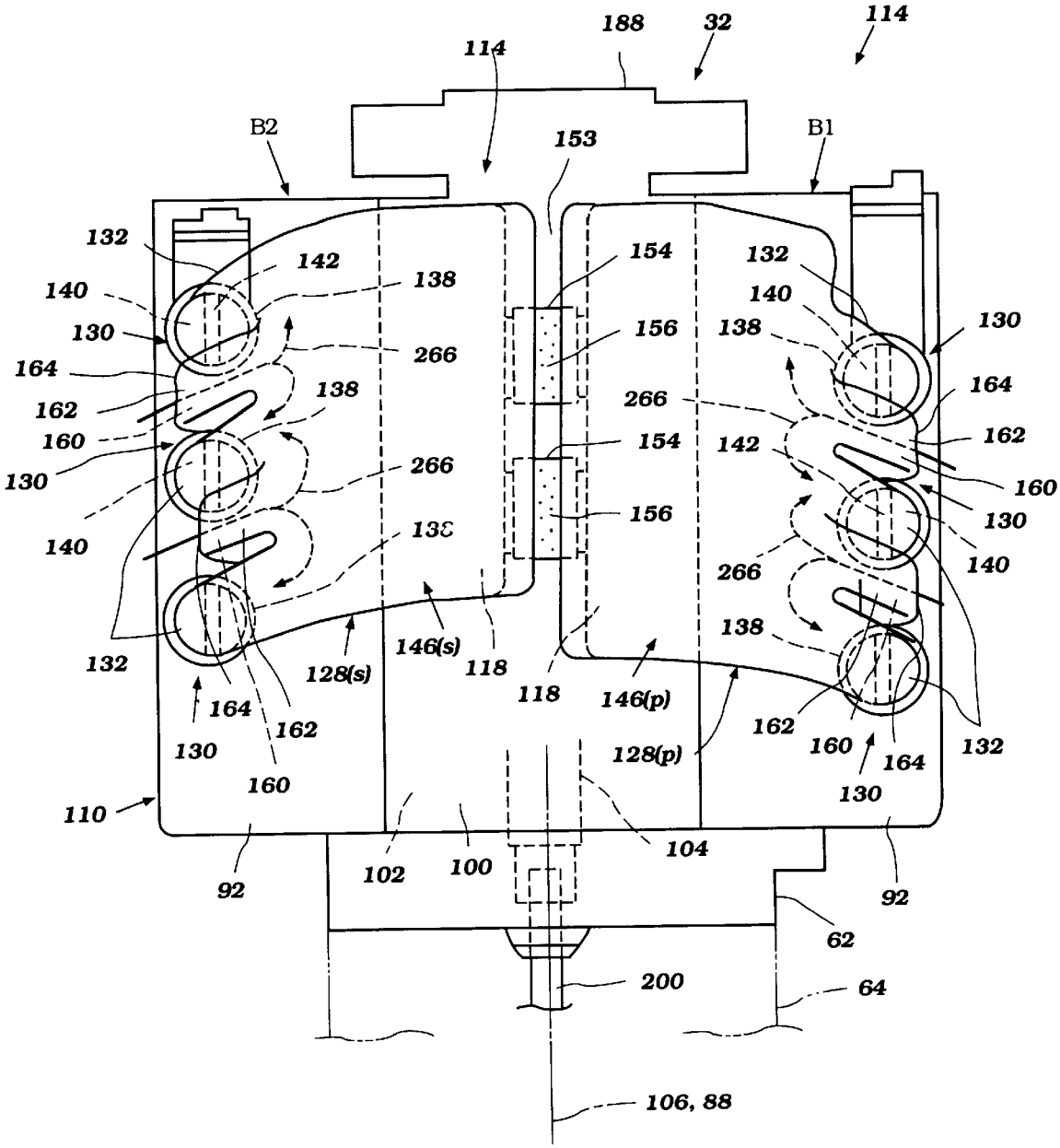
FIG. 3 is a front elevation view of the engine showing an air induction system of the engine.

FIGS. 1–3 illustrate the overall construction of a preferred embodiment of an internal combustion engine 32 configured in accordance with certain features, aspects and advantages of the present invention will be described. The engine 32 has particular utility in the context of a marine drive, such as the outboard motor 30 for instance, and thus is described in the context of an outboard motor. The engine 32, however, can be used with other types of marine drives (i.e., inboard motors, inboard/outboard motors, etc.) and also certain land vehicles, which includes lawnmowers, motorcycles, go carts, all terrain vehicles, automobiles and the like. Furthermore, the engine 32 can be used as a stationary engine for some applications that will become apparent to those of ordinary skill in the art.

In the illustrated arrangement, the outboard motor 30 further includes a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface 42 of a body of water. The bracket assembly 36 advantageously comprises a swivel bracket 44, a clamping bracket 46, a steering shaft 48 and a pivot pin 50.

The steering shaft 48 typically extends through the swivel bracket 44 and is affixed to the drive unit 34 by top and bottom mount assemblies 52. The steering shaft 48 is pivotally journaled for steering movement about a generally vertically extending steering axis defined within the swivel bracket 44. The clamping bracket 46 comprises a pair of bracket arms that are laterally spaced apart from each other and that are attached to the watercraft transom 38.

The pivot pin 50 completes a hinge coupling between the swivel bracket 44 and the clamping bracket 46. The pivot pin 50 extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front"mean at or to the side where the bracket assembly 36 is located, unless indicated otherwise or otherwise readily apparent from the context use. The arrows Fw of FIGS. 1, 2 and 4 indicate the forward direction. The terms "rear," "reverse," "backwardly" and "rearwardly" mean at or to the opposite side of the front side.

A hydraulic tilt and trim adjustment system shown generally at 56 is advantageously provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated system for tilting the drive unit 34. Typically, the term "tilt movement", when used in a broad sense, comprises both a tilt movement and a trim adjustment movement.

The illustrated outboard motor 30 includes a power head 58 and a lower housing unit 60. Housing unit 60 includes an exhaust guide member 62, a driveshaft housing 64 and a lower section 66. The power head 58 is disposed above the housing unit 60 and includes the internal combustion engine 32 that is positioned within a protective cowling assembly 68, which preferably is made of plastic. In most arrangements, the protective cowling assembly 68 defines a generally closed cavity 69 in which the engine 32 is disposed. The engine 32, thus, is generally protected from environmental elements within the enclosure defined by the cowling assembly 68.

The protective cowling assembly 68 comprises a top cowling member 70 and a bottom cowling member 72. The top cowling member 70 is detachably affixed to the bottom cowling member 72 by a coupling mechanism so that a user, operator, mechanic or repairperson can access the engine 32 for maintenance or for other purposes. In some arrangements, the top cowling member 70 is advantageously hingedly attached to the bottom cowling member 72 such that the top cowling member 70 can be pivoted away from the bottom cowling member 72 for access to the engine 32. Such a pivoting allows the top cowling member 70 to be pivoted about the rear end of the power head 58, which facilitates access to the engine 32 from within the associated watercraft 40.

The top cowling member 70 preferably has a rear air intake opening 76 located through an upper rear portion of member 70. Thus, a rear intake member with one or more air ducts is unitarily formed with or is affixed to the top cowling member 70. The rear intake member, together with the upper rear portion of the top cowling member 70, generally defines a rear air intake space. Ambient air is drawn into the closed cavity 69 via the rear intake opening 76 and the air ducts of the rear intake member as indicated by the arrow 78 of FIG. 1. Typically, the top cowling member 70 tapers in girth toward its top surface, which is in the general proximity of the air intake opening 76. The taper helps to reduce the lateral dimension of the outboard motor 32, which helps to reduce the air drag on the watercraft during movement.

The bottom cowling member 72 preferably has an opening through which an upper portion of the exhaust guide member 62 extends. The exhaust guide member 62 preferably is made of aluminum alloy and is affixed atop the driveshaft housing 64. The bottom cowling member 72 and the exhaust guide member 62 together generally form a tray. The engine 32 is placed onto this tray and can be affixed to the exhaust guide member 62. The exhaust guide member 62 also defines an exhaust discharge passage through which burnt charges (e.g., exhaust gases) from the engine 32 pass.

The engine 32 in the illustrated embodiment preferably operates on a four-cycle combustion principle. With reference now to FIG. 2, engine 32 has a cylinder block 84 configured as a V shape. The cylinder block 84 thus provides two cylinder banks B1, B2 which extend side by side with each other. In the illustrated arrangement, the cylinder bank B1 is disposed on the port side, while the cylinder bank B2 is disposed on the starboard side. In the illustrated arrangement, each cylinder bank B1, B2 has three cylinder bores 86 such that the cylinder block 84 has six cylinder bores 86 in total. The cylinder bores 86 of each bank B1, B2 extend generally horizontally and are generally vertically spaced from one another. As used in this description, the term "horizontally" means that the subject portions, members or components extend generally in parallel to the water surface 42 (i.e., generally normal to the direction of gravity) when the associated watercraft 40 is substantially stationary with respect to the water surface 42 and when the drive unit 34 is not tilted (i.e., is placed in the position shown in FIG. 1). The term "vertically" in turn means that portions, members or components extend generally normal to those that extend horizontally.

The illustrated engine 32 is generally symmetrical about a longitudinal center plane 88 that extends generally vertically and fore to aft of the outboard motor 30. This type of engine, however, merely exemplifies one type of engine on which various aspects and features of the present invention can be suitably used. Engines having other numbers of cylinders, having other cylinder arrangements (in-line, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A moveable member, such as a reciprocating piston 90, moves relative to the cylinder block 84 in a suitable manner. In the illustrated arrangement, a piston 90 reciprocates within each cylinder bore 86.

Because the cylinder block 84 is split into the two cylinder banks B1, B2, each cylinder bank B1, B2 extends outwardly at an angle with respect to center plane 88. Separate cylinder head assemblies 92 are affixed to the first ends of the cylinder banks B1, B2 to close those ends of the cylinder bores 86. The cylinder head assemblies 92, 94, together with the associated pistons 90 and cylinder bores 86, define six combustion chambers 96. Of course, the number of combustion chambers can vary, as indicated above.

A crankcase member 100 closes the other end of the cylinder bores 86 and, together with the cylinder block 84, defines a crankcase chamber 102. A crankshaft 104 extends generally vertically through the crankcase chamber 102 and is journaled for rotation about a rotational axis 106 by at least one bearing block. The rotational axis 106 of the crankshaft 104 preferably is on the longitudinal center plane 88. Connecting rods 108 couple the crankshaft 104 with the respective pistons 90 in any suitable manner. Thus, the reciprocal movement of the pistons 90 rotates the crankshaft 104.

As shown, the crankcase member 100 is located at the forward-most position of the engine 32, with the cylinder block 84 and the cylinder head assemblies 92, 94 being disposed rearward from the crankcase member 100, one after another. Generally, the cylinder block 84 (or individual cylinder bodies), the cylinder head assemblies 92, 94 and the crankcase member 100 together define an engine body 110.

Preferably, at least these major engine portions 84, 92, 94, 100 are made of aluminum alloy. The aluminum alloy advantageously increases strength over cast iron while decreasing the weight of the engine body 110.

Engine 32 further includes an air induction system 114. The system will be described in detail below. The air induction system 114 draws air from the cavity 69 within the cowling 68 into the combustion chambers 96. The air induction system 114 advantageously has six intake passages 116 and a pair of plenum chambers 118. In the illustrated arrangement, each cylinder bank B1, B2 is allotted with three intake passages 116 and one plenum chamber 118. Each plenum chamber 118 provides an expansion chamber that has a large volume such that intake noise can be sufficiently reduced. In the following description, the intake passages and the plenum chambers on each cylinder bank B1, B2 are sometimes distinguished from each other by indicating the intake passages and the plenum chamber of the cylinder bank B1 with the reference numerals 116P and 118P, respectively and the intake passages and the plenum chamber of the cylinder bank B2 with by the reference numerals 116S and 118S, respectively.

The most-downstream portions of the intake passages 116 are inner intake passages 120 within the cylinder head assemblies 92. The inner intake passages 120 communicate with the combustion chambers 96 through intake ports 122, which are formed at inner surfaces of the cylinder head assemblies 92. Typically, each of the combustion chambers 96 has one or more intake ports 122. Intake valves 124 are slideably disposed at each cylinder head assembly 92 to move between an open position and a closed position. As such, the valves 124 act to open and close the ports 122 to control the flow of air into the combustion chamber 96. Biasing members, such as springs, are used to urge the intake valves 124 toward the respective closed positions by acting between a mounting boss formed on each cylinder head assembly 92 and a corresponding retainer that is affixed to each of the valves 124. When each intake valve 124 is in the open position, the inner intake passage 120 that is associated with the intake port 122 communicates with the corresponding combustion chamber 96.

Outer portions of the intake passages 116, which are disposed outside of the cylinder head assemblies 92, comprise intake conduits 128. Each intake conduit 128 includes a throttle valve assembly 130. In the illustrated arrangement, the intake conduit 128 is formed with two conduit sections 132, 134 with the throttle valve assembly 130 being positioned therebetween. The conduit section 132 is located more upstream than the conduit section 134. While the conduit section 132 preferably is made of plastic, the conduit section 134 preferably is made of aluminum alloy. The intake conduits 128P allotted to the cylinder bank B1 extend forwardly along a side surface of the engine body 110 on the port side from the cylinder head assembly 92 on this side to the front of the crankcase member 100. The intake conduits 128S allotted to the cylinder bank B2 extend forwardly along a side surface of the engine body 110 on the starboard side from the cylinder head assembly 92 on this side to the front of the crankcase member 100.

Each throttle valve assembly 130 preferably includes a throttle body 138 and a throttle valve 140 disposed within the throttle body 138. The throttle bodies 138 preferably are made of aluminum alloy. Preferably, the throttle valves 140 are butterfly valves that have valve shafts 142 journaled for pivotal movement about a generally vertical axis. In some arrangements, the valve shafts 142 are linked together and are connected to a control linkage. The control linkage would be connected to an operational member, such as a throttle lever, that is provided on the watercraft 40 or otherwise proximate the operator of the watercraft 40. The operator can control the opening degree of the throttle valves 140 in accordance with operator demand through the control linkage. That is, the throttle valve assemblies 130 can measure or regulate amounts of air that flow through the intake passages 116 to the combustion chambers 96 in response to the operation of the operational member by the operator. Normally, the greater the opening degree, the higher the rate of airflow and the higher the engine speed.

The respective plenum chambers 118 preferably are defined with plenum chamber units or members 146 which are disposed side by side in front of the crankcase member 100. Preferably, the plenum chamber units 146 are arranged substantially symmetrically relative to the longitudinal center plane 88. In the illustrated embodiment, each plenum chamber unit 146 comprises outer and inner pieces 148, 150. Preferably, the illustrated outer and inner pieces 148, 150 unitarily form the plenum chamber unit 146 with the intake conduits 128. In other words, each outer piece 148 defines an outer portion of the plenum chamber unit 146 and three outer portions of the respective intake conduits 128. Each inner piece 150 in turn defines an inner portion of the plenum chamber unit 146 and three inner portions of the respective intake conduits 128. The outer and inner pieces 148 and 150 are coupled together along a coupling line 152 by proper fasteners such as, for example, bolts to complete the plenum chamber unit 146 and the three intake conduits 128. The plenum chamber units 146 are advantageously made of plastic. The plenum chambers 118 coordinate or smooth the airflow delivered to each intake passage 116 and also act as silencers to reduce intake noise.

A space or gap 153 (see FIGS. 2, 3) is preferably formed between both the plenum chamber units 146. In the space 153, two coupler members or air pressure balancer hoses 154, which preferably are made of a rubber material, define coupling passages 156 that connect both the plenum chambers 118 with each other. The air in both of the chambers 118 also is coordinated with one another through the coupler members 154. Because connected with each other, both the plenum chambers 118 can occasionally function in unison as a single chamber. That is the plenum chamber units 146 together define the single plenum chamber and hence the respective chamber units 146 define sections of the single plenum chamber. The space 153 is advantageous because the air around the engine body 110 can move out to a location opposite to the crankcase member 100 relative to the coupler members 154 and the air between the induction system 114 and the cowling assembly 68 conversely move in to a location around the engine body 110 through the space 153. That is, even though such relatively large plenum chamber units 146 are provided, the air within the closed cavity 69 can freely flow around the engine body 110.

Figure 4:
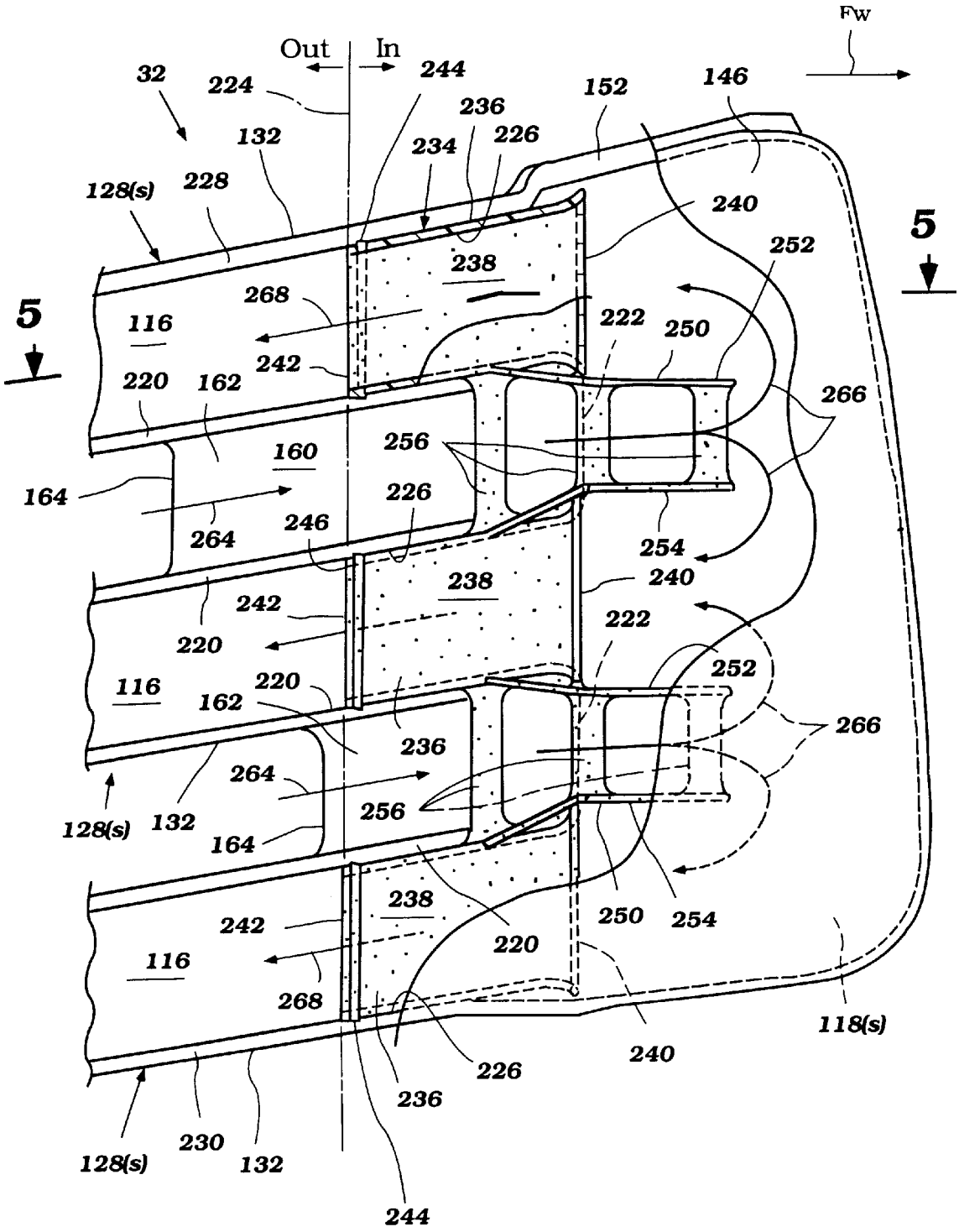
FIG. 4 is an enlarged, partial side elevation view of the induction system on the starboard side looked in the direction indicated by the arrow 4 of FIG. 5. An outer piece is removed in this figure.

The air in the cavity 69 enclosed by the cowling 68 is drawn into the respective plenum chambers 118 through inlet passages 160 defined by inlet conduits 162. As shown in FIGS. 3, 4, each plenum chamber unit 146 has two inlet conduits 162. The inlet conduits 162 include inlet openings 164 at their respective ends 118 through which the air enters from cavity 69. The openings 164 of the inlet passages 160 are directed generally rearwardly. As will be described in detail below, the conduits 162 provide inlet passages 160 having a certain length from the opening 164 to the associated plenum chamber 118. This length is one of important elements in determination of the engine torque. For instance, the exemplary engine 32 requires high torque in a range of low and/or middle engine speed. The length of the intake conduits 128, however, are circumscribed by the narrow cavity space 69 between the engine and the inside wall of the cowling 68. These conduits are not long enough to provide intake passages 116 that are suitable for creating the required torque. As described below, however in the preferred embodiment shown, the length of the inlet passages 160 is added to elongate the length of the intake passages 116. In order to elongate the passages 116 within such a narrow cavity 69, the illustrated inlet conduits 162 extends both along and between the intake conduits 128.

The intake conduits 128, the plenum chamber units 146, the inlet conduits 162 and their circumferential constructions will be described in greater detail below with additional reference to FIGS. 4 and 5.

With reference still to FIGS. 1 and 2, the engine 32 also includes an exhaust system that routes burnt charges, i.e., exhaust gases, to a location outside of the outboard motor 30. Each cylinder head assembly 92 defines a set of inner exhaust passages 168 that communicate with the combustion chambers 96 through one or more exhaust ports 170, which may be defined at the inner surfaces of the respective cylinder head assemblies 92. The exhaust ports 170 can be selectively opened and closed by exhaust valves 172. The construction of each exhaust valve 172 and the arrangement of the exhaust valves 172 are substantially the same as the intake valve 124 and the arrangement thereof, respectively. Thus, further description of these components is deemed unnecessary.

Exhaust manifolds 178 preferably are defined generally vertically within the respective cylinder head assemblies 92. The exhaust manifolds 178 communicate with the combustion chambers 96 through the inner exhaust passages 168 and the exhaust ports 170 to collect exhaust gases therefrom. The exhaust manifolds 168 are coupled with the exhaust discharge passage of the exhaust guide member 62. When the exhaust ports 170 are opened, the combustion chambers 96 communicate with the exhaust discharge passage through the exhaust manifolds 168.

A valve cam mechanism (not shown) preferably is provided for actuating the intake and exhaust valves 124, 172 in each cylinder bank B1, B2. Preferably, the valve cam mechanism includes one or more camshafts per cylinder bank, which camshafts extend generally vertically and are journaled for rotation relative to the cylinder head assemblies 92. The camshafts have cam lobes to push valve lifters that are affixed to the respective ends of the intake and exhaust valves 124, 172 in any suitable manner. The cam lobes repeatedly push the valve lifters in a timed manner, which is in proportion to the engine speed. The movement of the lifters generally is timed by rotation of the camshafts to appropriately actuate the intake and exhaust valves 124, 172.

A camshaft drive mechanism (not shown) preferably is provided for driving the valve cam mechanism. Thus, the intake and exhaust camshafts comprise intake and exhaust driven sprockets positioned atop the intake and exhaust camshafts, respectively, while the crankshaft 104 has a drive sprocket positioned atop thereof. A timing chain or belt is wound around the driven sprockets and the drive sprocket. The crankshaft 104 thus drives the respective camshafts through the timing chain in the timed relationship. Because the camshafts must rotate at half of the speed of the rotation of the crankshaft 104 in a four-cycle engine, a diameter of the driven sprockets is twice as large as a diameter of the drive sprocket.

The engine 32 preferably has indirect, port or intake passage fuel injection system. The fuel injection system preferably comprises six fuel injectors 180 with one fuel injector allotted for each one of the respective combustion chambers 96. The fuel injectors 180 preferably are mounted on the throttle bodies 138 and a pair of fuel rails connects the respective fuel injectors 180 with each other on each cylinder bank B1, B2. The fuel rails also define portions of the fuel conduits to deliver fuel to the injectors 180.

Each fuel injector 180 preferably has an injection nozzle directed downstream within the associated intake passage 116, which is defined within the conduit section 134 downstream of the throttle valve assembly 130. The fuel injectors 180 spray fuel into the intake passages 116, as indicated by the arrows 182 of FIG. 2, under control of an electronic control unit (ECU). The ECU controls both the initiation timing and the duration of the fuel injection cycle of the fuel injectors 180 so that the nozzles spray a proper amount of fuel each combustion cycle.

Typically, a fuel supply tank disposed on a hull of the associated watercraft 40 contains the fuel. The fuel is delivered to the fuel rails through the fuel conduits and at least one fuel pump, which is arranged within the conduits. The fuel pump pressurizes the fuel to the fuel rails and finally to the fuel injectors 180. A vapor separator 186 preferably is disposed along the conduits to separate vapor from the fuel and can be mounted on the engine body 110 at the side surface on the port side. It should be noted that a direct fuel injection system that sprays fuel directly into the combustion chambers can replace the indirect fuel injection system described above. Moreover, other charge forming devices, such as carburetors, can be used instead of the fuel injection systems.

The engine 32 further comprises an ignition or firing system (not shown). Each combustion chamber 96 is provided with a spark plug which preferably is disposed between the intake and exhaust valves 124, 172. Each spark plug has electrodes that are exposed into the associated combustion chamber 96 and that are spaced apart from each other with a small gap. The spark plugs are connected to the ECU through appropriate ignition devices such as, for example, ignition coils such that ignition timing is controlled by the ECU.

In the illustrated engine 32, the pistons 90 reciprocate between top dead center and bottom dead center. When the crankshaft 104 makes two rotations, the pistons 90 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 90, the camshafts make one rotation and actuate the intake and exhaust valves 124, 172 to open the intake and exhaust ports 122, 170 during the intake stroke and the exhaust stroke, respectively.

Generally, during the intake stroke, air is drawn into the combustion chambers 96 through the air induction system 114 and fuel is injected toward the combustion chambers 96 by the fuel injectors 180. The air and the fuel thus are mixed to form the air/fuel charge in the combustion chambers 96. Slightly before or during the power stroke, the respective spark plugs ignite the compressed air/fuel charge in the respective combustion chambers 96. The air/fuel charge thus rapidly burns during the power stroke to move the pistons 90. The burnt charge, i.e., exhaust gases, then are discharged from the combustion chambers 96 during the exhaust stroke.

The engine 32 may further employ other systems such as, for example, a cooling system and a lubrication system. Various mechanism and/or devices can also be used for the engine 32. For instance, a flywheel assembly 188 preferably is positioned atop of the crankshaft 104 and is journaled for rotation with the crankshaft 104. The flywheel assembly 188 typically comprises a flywheel magneto or AC generator that supplies electric power to various electrical components, such as the fuel injection system, the ignition system and the ECU.

With reference to FIG. 1, the driveshaft housing 64 is positioned below the exhaust guide member 62 to support a driveshaft 200 which extends generally vertically through the driveshaft housing 64. The driveshaft 200 is journaled for rotation and is driven by the crankshaft 104. The driveshaft housing 64 preferably defines an internal section 202 of the exhaust system that leads the majority of exhaust gases to the lower unit 66. The internal section 202 preferably includes an idle discharge portion that is branched off from a main portion of the internal section 202 to discharge idle exhaust gases directly out to the atmosphere in idle speed of the engine 32 through a discharge port that preferably is formed on a rear surface of the driveshaft housing 64. The exhaust internal section 202 is schematically shown in FIG. 1 to include a portion of the exhaust manifolds and the exhaust discharge passage.

The lower unit 66 depends from the driveshaft housing 64 and supports a propulsion shaft 206 that is driven by the driveshaft 200. The propulsion shaft 206 extends generally horizontally through the lower unit 66 and is journaled for rotation. A propulsion device is attached to the propulsion shaft 206. In the illustrated arrangement, the propulsion device is a propeller 208 that is affixed to an outer end of the propulsion shaft 206. The propulsion device, however, can take the form of a dual counter-rotating system, a hydrodynamic jet, or any of a number of other suitable propulsion devices.

A transmission 210 preferably is provided between the driveshaft 200 and the propulsion shaft 206, which lie generally normal to each other (i.e., at a 90° shaft angle) to couple together the two shafts 200, 206 by bevel gears. The outboard motor 30 has a clutch mechanism that allows the transmission 210 to change the rotational direction of the propeller 208 among forward, neutral or reverse.

The lower unit 66 also defines an internal section of the exhaust system that is connected with the internal exhaust section 202 of the driveshaft housing 64. At engine speeds above idle, the exhaust gases generally are discharged to the body of water surrounding the outboard motor 30 through the internal sections and then a discharge section defined within the hub of the propeller 208. Additionally, the exhaust system can include a catalytic device at any location in the exhaust system to purify the exhaust gases.

The Air Induction System

With reference still to FIGS. 1–3 and additionally with reference to FIGS. 4 and 5, the air induction system 114 will now be described in greater detail below.

The illustrated inlet conduits 162 on each side (starboard or port side) are advantageously integrally formed as a unit. As a result, the intake conduits 132, the plenum chamber unit 118 and the inlet conduits 162 are all part of the same bank as a unit. As a result, the outer and inner pieces 148, 150 provide the inlet conduits 162. As shown in FIG. 4, unified wall portions 220 thus separate the intake and inlet passages 116, 160. An inner diameter of the respective inlet conduits 162 is generally equal to an inner diameter of the respective intake conduits 132. The inlet conduit 162 positioned higher than the other inlet conduit 162 is slightly longer than the other inlet conduit 162. Each inlet conduit 162 has an opening 222 within the plenum chamber 118 downstream from the inlet opening 164.

The plenum chamber 118 and the respective intake passages 116 are thus connected with each other. As shown in FIGS. 4 and 5, the phantom line 224 conveniently indicates the intake passages 116 separated from the plenum chamber 118. The plenum chamber unit 146 preferably includes three hollow portions 226 that are formed by an upper shell portion 228, a lower shell portion 230 and the integral wall portions 220 with the wall portions 220 extending within the plenum chamber 118 to define the hollow portions 226. Thus, as shown in FIG. 4, each hollow portion 226 has a height that is almost equal to the inner diameter of the intake passage 116.

A unitary conduit member 234 preferably is fitted into each of the hollow portions 226. The unitary conduit member 234 has three mounting portions 236 that are fitted into the respective hollow portions 226. Each mounting portion 236 has a tubular shape that defines a pathway 238 through which the air passes. The pathways 238 substantially form extensions of the intake passages 116 within the plenum chamber 118. The mounting portions 236 include intake openings 240 that are positioned adjacent to the chamber side openings 222 of the inlet conduits 162. As shown in FIG. 4, intake ports 240 within the plenum chamber are preferably aligned with the chamber side openings 222 and face generally the same direction as the chamber side openings 222. Opposite ends 242 form flanges 244, while the inner and outer pieces 148, 150 together form grooves 246 with which the flanges 244 can engage. The flanges 244 engage with the grooves 246 and advantageously prevent the mounting portions 236 from slipping off location.

Connecting portions 250 preferably couple the respective mounting portions 236 with each other. The illustrated connecting portions 250 are integrally formed with the mounting portions 236. Each connecting portion 250 is positioned generally forwardly of the inlet conduit 162 disposed between the mounting portions 236. Each connecting portion 250 preferably comprises upper and lower baffle sections 252, 254 both extending forwardly toward the coupling passages 156. The upper baffle section 252 is placed in close proximity to the mounting portion 236 located above the inlet conduit 162, while the lower baffle section 254 is placed in close proximity to the mounting portion 236 located below the same inlet conduit 162. As shown in FIG. 5, the upper and lower baffle sections 252, 254 have areas, which are generally equal to each other, to cause the air flowing from the inlet passage 160 to detour around the baffle sections 252 before entering the openings 240 of the mounting portions 236. Preferably, three pillars 256 connect the upper and lower baffle sections 252, 254 with each other. Specifically, two of the pillars 256 are located downstream and at almost the end of the baffle sections 252 to connect only the upper and lower baffle sections 252, 254. The other one of the pillars 256 in turn is located more upstream to connect not only the upper and lower baffle sections 252 but also the mounting portions 236 themselves.

The integral conduit member 234 preferably is made of plastic. Any conventional methods such as, for example, a casting method or an injection method can be applied to produce the integral conduit member 234.

Figure 5:
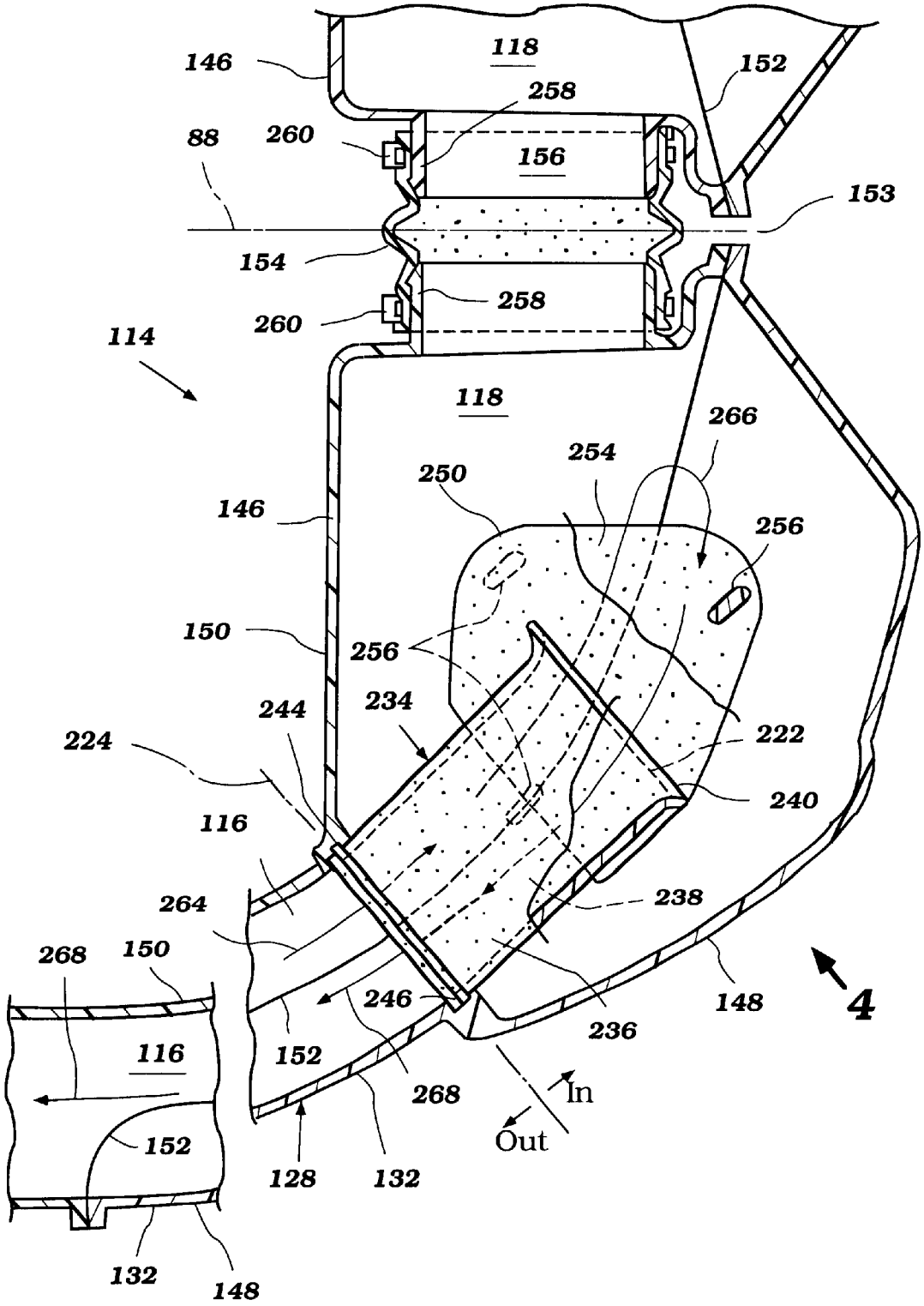
FIG. 5 is an enlarged, partial top plan view of the induction system on the same side shown in section generally along the line 5—5 of FIG. 4. A halfway portion of the intake conduit is omitted to shorten the figure.

As shown in FIG. 5, the coupler members 154 that connect the plenum chamber units 146 are preferably bellows type hoses. Each plenum chamber unit 146 has a projection 258 extending oppositely to each other. The coupler members 154 are fitted onto outside surfaces of the projections 258. Metal bands 260 rigidly fix ends of the coupler members 154 to the projections 258.

The air in the cavity 69 enclosed by the protective cowling assembly 68 is drawn into the inlet passages 160 through the inlet openings 164 and flows toward the plenum chamber 118 as indicated by the arrows 264 of FIGS. 2, 4 and 5. The air then moves into the plenum chamber 118 through the chamber side openings 222 where the air flow is caused to change in direction toward the pathways 238 positioned next to the inlet passages 162 as indicated by the arrows 266 of FIGS. 2–5. In this movement, the baffle sections 252, 254 inhibit the air from directly entering the openings 240 of the mounting portions 236 and rather lead it to detour around the baffle sections 252, 254. Then, the air proceeds to the intake passages 116 from the pathways 238 and flows through the intake passages 116 as indicated by the arrows 268 of FIGS. 2, 4 and 5. The amount of the air that can flow through the intake passages 116 is determined by the throttle valve assemblies 130. Air that passes through the throttle valve assemblies 130 finally moves into the combustion chambers 96 as indicated by the arrows 270 of FIG. 2 when the intake valves 124 are in the open position.

In the illustrated preferred embodiment, the plenum chambers 118 advantageously smooth the air before the air is delivered to the respective intake passages 116 and reduce the intake noise.

As described above, the induction inlet conduits 162 have sufficient length for providing the desired engine torque in a range of low and/or middle engine speed. The air induction system 114 enhances these effects with the baffle sections 250 within the plenum chamber 118 because the air and/or intake noise travels longer distances than without the baffle sections 250 and the intake noise is thereby reduced. In addition, the illustrated inlet conduits 162 extend along the intake conduits 132 therebetween. No additional space between the engine and the inside wall of the cowling is used for the inlet conduits 162. In other words, the illustrated air induction system 114 can have relatively long intake conduits 132 without requiring a roomier space around the engine body 110 in the closed cavity 69. Also, the illustrated plenum chamber unit 146, the intake conduits 132 and the inlet conduits 162 on each side are substantially integrally formed in with the two pieces 148, 150. The illustrated air induction system 114 thus can decrease a number of parts that forms the system. Additionally, the openings 164 of the inlet passages 160 in the illustrated embodiment direct generally rearwardly opposite to the associated watercraft 40. As a result, the air induction system 114 can advantageously reduce the noise toward the operator in the watercraft 40 accordingly.

Of course, the foregoing description is that of a preferred construction having certain features, aspects and advantages in accordance with the present invention. Various changes and modifications may be made to the above-described arrangements without departing from the spirit and scope of the invention, as defined by the appended claims. For instance, the intake conduits do not necessarily extend along outer surfaces of the engine body and can extend between the both cylinder banks. In this arrangement, the exhaust manifolds instead can extend along the outer surfaces of the engine body.

What is claimed is:

1. An air intake system for improving the torque characteristics of an outboard marine engine having two banks of cylinders and limited space between the engine and its protective cowling, said system comprising:

first and second plenum chambers located at approximately the midpoint of the crankcase housing of said engine between said engine and said protective cowling;

first and second intake conduits each including a throttle valve assembly at their downstream end and respectively connected to said first and second plenum chambers at their upstream end; and first and second inlet conduits respectively located substantially between said intake conduits and in the plane of said intake conduits;

said inlet conduits respectively extending between an air inlet open to the cavity enclosed by said protective cowling and said first and second plenum chambers so that the effective length of the air intake conduit is lengthened to improve the low and middle range torque vale of said engine.

2. The air intake system of claim 1, wherein said first and second plenum chambers reverse the flow of air coming from said inlet conduits so that the flow of air in said intake conduits is substantially opposite to the flow of air in said inlet conduits.

3. The air intake system of claim 1, wherein said plenum chambers have internal baffles in the path of air flowing through said chambers.

4. The air intake system of claim 3, wherein said baffles lengthen the flow of air within said chambers.

5. The air intake system of claim 3, wherein said baffles smooth the flow of air within said chambers.

6. The air intake system of claim 3, wherein said baffles reduce the intake noise.

7. The air intake system of claim 1, wherein said inlet conduits extend substantially the length of said intake conduits.

8. The air intake system of claim 1, wherein said first and second inlet conduits and said intake conduits are respectively located in a vertical bank approximately parallel to the axis of rotation of the crankshaft of said engine, said banks extend around substantially one-half of the distance around the exterior of said engine as measured in a plane perpendicular to the rotational axis of said crankshaft.

9. The air intake system of claim 2, wherein the walls of said first intake conduits, said first plenum chamber and said first intake conduit are substantially provided by two formed pieces.

10. The air intake system of claim 9, wherein said two formed pieces are made from plastic.

11. The air intake system of claim 1, wherein said air intake conduits are vertically stacked proximate to the crankcase housing of said engine.

12. The air intake system of claim 11, wherein said engine has six cylinders with three cylinders in each bank, said first and second intake conduit each comprising three conduits and said first and second inlet conduits each comprising two conduits, interleaved between said intake conduits.

13. An air intake system for an internal combustion engine having an extended length within a narrow space, comprising:

an intake conduit;

an inlet conduit extending alongside and substantially parallel to said intake conduit;

a plenum chamber connected to the upstream end of said intake conduit and to the downstream end of said inlet conduit; and an air inlet formed at the upstream end of said inlet conduit to introduce fresh air into the inlet conduit, said air inlet being located generally physically proximate to the downstream end of said inlet conduit while providing a sufficiently long air flow from said air inlet to the combustion chamber of said engine to improve the torque characteristics of said engine.

14. The air intake system of claim 13, wherein said plenum chamber reverses the flow of air so that the flow of air within said intake conduit is substantially reversed from the flow of air within said air inlet conduit.

15. An internal combustion engine comprising an engine body and an air induction system, the engine body including a cylinder block defining at least one cylinder bore, a piston reciprocally disposed within the cylinder bore, and a cylinder head member closing the respective cylinder bores to define a combustion chamber together with the cylinder bore and the piston, the air induction system arranged to supply at least fresh air to the combustion chamber, the air induction system including an intake conduit communicating with the combustion chamber, and an inlet conduit communicating with the intake conduit and, at least in part, extending along the intake conduit, the inlet conduit defining an inlet opening that communicates with air outside the engine.

16. The engine as set forth in claim 15, wherein the air induction system additionally includes a plenum chamber member defining a plenum chamber therein, and the inlet conduit communicates with the intake conduit through the plenum chamber.

17. The engine as set forth in claim 16, wherein the intake conduit has a first opening within the plenum chamber.

18. The engine as set forth in claim 16, wherein the cylinder head member is located on one side of the engine body, the plenum chamber member is located generally on another side of the engine body opposite to the cylinder head member, the intake conduit extends generally along the engine body, and the inlet conduit has an opening that faces toward the side on which the cylinder head member is located.

19. The engine as set forth in claim 16, wherein the intake conduit defines an intake passage, and the plenum chamber member contains an extension defining an extended portion of the intake passage.

20. The engine as set forth in claim 15, wherein the intake conduit extends generally along the engine body.

21. The engine as set forth in claim 15, wherein the engine operates on a four-cycle combustion principle.

22. The engine as set forth in claim 15, wherein the engine powers a marine propulsion device.

23. An internal combustion engine comprising an engine body and an air induction system, the engine body including a cylinder block defining at least one cylinder bore, a piston reciprocally disposed within the cylinder bore, and a cylinder head member closing the respective cylinder bores to define a combustion chamber together with the cylinder bore and the piston, the air induction system arranged to supply air to the combustion chamber, the air induction system including an intake conduit communicating with the combustion chamber, an inlet conduit communicating with the intake conduit and, at least in part, extending along the intake conduit, and a plenum chamber member defining a plenum chamber therein, the inlet conduit communicating with the intake conduit through the plenum chamber, the intake conduit having a first opening within the plenum chamber, and the inlet conduit having a second opening within the plenum chamber.

24. The engine as set forth in claim 23, wherein the inlet conduit has a third opening at a location opposite to the second opening and out of the plenum chamber.

25. The engine as set forth in claim 24, wherein the plenum chamber member is positioned at a location generally opposite to a location where the cylinder head member is positioned, and the third opening generally faces toward the location of the cylinder head member.

26. The engine as set forth in claim 23, wherein the first and second openings face generally the same direction.

27. The engine as set forth in claim 23, wherein the air induction system additionally includes a baffle between the first and second openings so that the air detours around the baffle before entering the first opening from the second opening.

28. The engine as set forth in claim 27, wherein the intake conduit defines an intake passage, the first opening is formed at an upstream end of the intake passage, the plenum chamber provides a hollow space communicating with the intake passage, and the baffle has a mounting portion that fits into said hollow space.

29. The engine as set forth in claim 28, wherein the mounting portion has a tubular shape that defines a pathway through which the air passes.

30. An internal combustion engine comprising an engine body and an air induction system, the engine body including a cylinder block defining at least one cylinder bore, a piston reciprocally disposed within the cylinder bore, and a cylinder head member closing the respective cylinder bores to define a combustion chamber together with the cylinder bore and the piston, the air induction system arranged to supply air to the combustion chamber, the air induction system including an intake conduit communicating with the combustion chamber, an inlet conduit communicating with the intake conduit and, at least in part, extending along the intake conduit, and a plenum chamber member defining a plenum chamber therein, the inlet conduit communicating with the intake conduit through the plenum chamber, and the inlet conduit having an opening within the plenum chamber.

31. An internal combustion engine comprising an engine body and an air induction system, the engine body including a cylinder block defining at least two cylinder bores, pistons reciprocally disposed within the respective cylinder bores, and a cylinder head member closing each one of the respective cylinder bores to define at least two combustion chambers together with the cylinder bores and the pistons, the air induction system including at least two intake conduits communicating with the combustion chambers, and an inlet conduit communicating with both of the intake conduits, the inlet conduit, at least in part, extending along the intake conduits, the inlet conduit defining an inlet opening that communicates with air outside the engine.

32. The engine as set forth in claim 31, wherein the air induction system additionally includes a plenum chamber member defining a plenum chamber therein, and the inlet conduit communicates with the intake conduits through the plenum chamber.

33. The engine as set forth in claim 32, wherein each one of the intake conduits has a first opening within the plenum chamber.

34. The engine as set forth in claim 31, wherein the intake conduits define intake passages, the plenum chamber member contains extensions defining extended portions of the respective intake passages, and the extensions are connected with each other.

35. An internal combustion engine comprising an engine body and an air induction system, the engine body including a cylinder block defining at least two cylinder bores, pistons reciprocally disposed within the respective cylinder bores, and a cylinder head member closing each one of the respective cylinder bores to define at least two combustion chambers together with the cylinder bores and the pistons, the air induction system including at least two intake conduits communicating with the combustion chambers, and an inlet conduit communicating with both of the intake conduits, the inlet conduit, at least in part, extending along the intake conduits, and a plenum chamber member defining a plenum chamber therein, the inlet conduit communicating with the intake conduits through the plenum chamber, each one of the intake conduits having a first opening within the plenum chamber, and the inlet conduit having a second opening within the plenum chamber.

36. The engine as set forth in claim 35, wherein at least one of the first openings and the second opening are positioned adjacent to each other.

37. The engine as set forth in claim 36, wherein the air intake system additionally includes at least one baffle disposed between of the first openings and the second opening so that the air detours around the baffle before entering the first openings from the second opening.

38. An internal combustion engine comprising an engine body, a moveable member moveable relative to the engine body, the engine body and the moveable member together defining a combustion chamber, and an air induction system arranged to supply at least fresh air to the combustion chamber, the air induction system including an intake conduit communicating with the combustion chamber, a plenum chamber member defining a plenum chamber located upstream of the intake conduit, and an inlet conduit communicating with the plenum chamber, the inlet conduit defining an inlet opening to introduce the fresh air into the inlet conduit, the inlet conduit, at least in part, being unitarily formed with the intake conduit.

39. The engine as set forth in claim 38, wherein the intake conduit has a first opening within the plenum chamber, the inlet conduit has a second opening within the plenum chamber, the first and second openings are positioned adjacent to each other.

40. The engine as set forth in claim 39, wherein the air intake system additionally includes at least one baffle disposed between the first opening and the second opening so that the air detours around the baffle before entering the first opening from the second opening.

41. The engine as set forth in claim 38, wherein the intake conduit defines an intake passage, the inlet conduit defines an inlet passage, and the intake and inlet conduits together define a unified wall portion separating the intake and inlet passages from each other.

42. The engine as set forth in claim 38, wherein the inlet conduit at least in part is unitarily formed with the plenum chamber member.

43. The engine as set forth in claim 38, wherein the intake conduit at least in part is integrally formed with the plenum chamber member.

44. An internal combustion engine comprising an engine body, a moveable member moveable relative to the engine body, the engine body and the moveable member together defining a combustion chamber, and an air induction system arranged to supply air to the combustion chamber, the air induction system including an intake conduit communicating with the combustion chamber, a plenum chamber member defining a plenum chamber located upstream of the intake conduit, and an inlet conduit communicating with the plenum chamber to introduce the air into the plenum chamber, the inlet conduit, at least in part, being unitarily formed with the intake conduit, and the intake conduit having an internal portion that extends within the plenum chamber.

45. The engine as set forth in claim 44, wherein the internal portion is separately formed from an external portion of the intake conduit that extends out of the plenum chamber.

46. The engine as set forth in claim 45, wherein the intake conduit defines an intake passage, the plenum chamber member forms a hollow space communicating with the intake passage, and the internal portion fits into the hollow.

47. An internal combustion engine comprising an engine body, at least two moveable members moveable relative to the engine body, the engine body and the moveable members together defining at least two combustion chambers, and an air induction system arranged to supply at least fresh air to the combustion chambers, the air induction system including first and second intake conduits communicating with the combustion chambers, the first intake conduit extending on a first side of the engine body, the second intake conduit extending on a second side of the engine body, the second side being located generally oppositely to the first side relative to the engine body, at least one plenum chamber member defining a plenum chamber located upstream of the first and second intake conduits, and first and second inlet conduits communicating with the plenum chamber, the first inlet conduit defining a first inlet opening to introduce the fresh air into the first inlet conduit, the second inlet conduit defining a second inlet opening to introduce the fresh air into the second inlet conduit, the first inlet conduit at least in part extending generally along the first intake conduit, the second inlet conduit at least in part extending generally along the second intake conduit.

48. The engine as set forth in claim 47, wherein the plenum chamber member includes first and second plenum chamber sections, the first intake conduit communicates with the first plenum chamber section, and the second intake conduit communicates with the second plenum chamber section.

49. The engine as set forth in claim 48, wherein the first and second plenum chamber sections define a space therebetween at a location adjacent to one surface of the engine body, and the surface of the engine communicates with a location opposite to the surface of the engine relative to the first and second plenum chamber sections at least through the space.

50. The engine as set forth in claim 41, wherein the engine body generally forms a V-configuration, and the first and second intake conduits selectively extend on each side of the V-configuration.

51. An internal combustion engine comprising an engine body, at least two moveable members moveable relative to the engine body, the engine body and the moveable members together defining at least two combustion chambers, and an air induction system arranged to supply air to the combustion chambers, the air induction system including first and second intake conduits communicating with the combustion chambers, the first intake conduit extending on a first side of the engine body, the second intake conduit extending on a second side of the engine body, the second side being located generally oppositely to the first side relative to the engine body, at least one plenum chamber member defining a plenum chamber located upstream of the first and second intake conduits, first and second inlet conduits communicating with the plenum chamber, the first inlet conduit at least in part extending generally along the first intake conduit, the second inlet conduit at least in part extending generally along the second intake conduit, the plenum chamber member including first and second plenum chamber sections, the first intake conduit communicating with the first plenum chamber section, and the second intake conduit communicating with the second plenum chamber section, and a coupler conduit coupling the first and second plenum chamber sections with each other.

52. An internal combustion engine comprising an engine body, a moveable member moveable relative to the engine body, the engine body and the moveable member together defining a combustion chamber, and an air induction system arranged to supply at least fresh air to the combustion chamber, the air induction system including an intake conduit communicating with the combustion chamber, a plenum chamber member defining a plenum chamber located upstream of the intake conduit, and an inlet conduit communicating with the plenum chamber, the inlet conduit defining an inlet opening to introduce the fresh air into the inlet conduit, and the inlet conduit, at least in part, extending generally along the intake conduit.

53. An outboard motor comprising a drive unit including an internal combustion engine, and a cowling surrounding the engine to define a space between the engine and the cowling, the cowling defining an air intake opening through which air enters the space, the engine comprising an engine body, a moveable member moveable relative to the engine body, the engine body and the moveable member together defining a combustion chamber, an intake conduit communicating with the combustion chamber, a plenum chamber member defining a plenum chamber located upstream of the intake conduit, and an inlet conduit communicating with the plenum chamber to introduce the air within the space into the plenum chamber.

54. The outboard motor as set forth in claim 53, wherein the inlet conduit, at least in part, extends generally along the intake conduit.

55. The outboard motor as set forth in claim 53 additionally comprising a bracket assembly adapted to be mounted on an associated watercraft to support the drive unit, wherein the inlet conduit defining an opening positioned opposite to the bracket assembly relative to the plenum chamber member.

* * * * *